US010823452B2

(12) United States Patent
Miura

(10) Patent No.: US 10,823,452 B2
(45) Date of Patent: Nov. 3, 2020

(54) HEAT SOURCE MACHINE

(71) Applicant: RINNAI CORPORATION, Nagoya (JP)

(72) Inventor: Takuya Miura, Aichi (JP)

(73) Assignee: RINNAI CORPORATION, Nagoya (JP)

( * ) Notice: Subject to any disclaimer, the term of this patent is extended or adjusted under 35 U.S.C. 154(b) by 130 days.

(21) Appl. No.: 16/298,244

(22) Filed: Mar. 11, 2019

(65) Prior Publication Data

US 2019/0360723 A1 Nov. 28, 2019

(30) Foreign Application Priority Data

May 23, 2018 (JP) ..... 2018-098624

(51) Int. Cl.

| | |
|---|---|
| ***F24H 1/14*** | (2006.01) |
| ***F23L 5/02*** | (2006.01) |
| ***F24H 9/18*** | (2006.01) |
| ***F24H 8/00*** | (2006.01) |

(52) U.S. Cl.

CPC ..... *F24H 1/145* (2013.01); *F23L 5/02* (2013.01); *F24H 8/006* (2013.01); *F24H 9/1836* (2013.01)

(58) Field of Classification Search

CPC . F28F 1/20; F28F 1/325; F28F 9/0131; B23P 15/26; F24H 1/145; F24H 8/00; F28D 1/0426; F28D 1/05325; F28D 1/05375

See application file for complete search history.

(56) References Cited

U.S. PATENT DOCUMENTS

| | | | | |
|---|---|---|---|---|
| 6,340,051 | B1 * | 1/2002 | Bloksma | F28F 9/00 165/159 |
| 10,408,549 | B2 * | 9/2019 | Oohigashi | F28D 1/0426 |
| 2016/0273850 | A1 * | 9/2016 | Okamoto | F28F 21/083 |
| 2018/0238276 | A1 * | 8/2018 | Jeong | F28D 9/0031 |
| 2019/0323784 | A1 * | 10/2019 | Park | F28F 1/325 |
| 2020/0033071 | A1 * | 1/2020 | Kondo | F24H 1/124 |

FOREIGN PATENT DOCUMENTS

| | | | | |
|---|---|---|---|---|
| JP | 2002013825 A | * | 1/2002 | F28F 9/013 |
| JP | 2011033208 A | * | 2/2011 | |
| JP | 2011-144979 | | 7/2011 | |

* cited by examiner

*Primary Examiner* — Gregory A Wilson

(74) *Attorney, Agent, or Firm* — Rankin, Hill & Clark LLP

(57) ABSTRACT

Provided is a heat source machine with high thermal efficiency. A heat exchanger (3) is provided with a resistance imparting member (8) that imparts resistance to combustion exhaust passing through fins (11). The resistance imparting member (8) is provided with exhaust passage sections (17) which are positioned opposing water pipes (10), and belt-like closing sections (16) that close the gap between the fins (11) of the water pipes (10) that are adjoining to each other.

3 Claims, 4 Drawing Sheets

HEAT SOURCE MACHINE

BACKGROUND OF THE INVENTION

1. Field of the Invention

The present invention relates to a heat source machine provided with a burner and a heat exchanger heated by the combustion exhaust of the burner.

2. Description of the Related Art

A heat exchanger provided in this type of heat source machine generally includes a plurality of water pipes linearly extended with predetermined intervals provided thereamong and a plurality of fins installed with predetermined intervals provided thereamong along the directions in which the water pipes are linearly extended.

Hitherto, as this type of heat exchanger, there has been known a heat exchanger in which bent protrusions that block the flow of combustion exhaust are formed on fins (refer to, for example, Japanese Patent Application Laid-Open No. 2011-144979). The bent protrusions are formed by burring the fins. When a plurality of fins are attached to water pipes with predetermined intervals provided thereamong, the bent protrusions are positioned among water pipes, protruding toward adjoining fins.

This arrangement makes it possible to appropriately reduce the flow rate of combustion exhaust passing through the fins thereby to improve heat exchange efficiency.

However, the bent protrusions formed on the fins tend to cause gaps relative to adjoining fins due to the influences of the deformation or the like that takes place when attaching the fins to the water pipes. A gap generated between a bent protrusion and an adjoining fin causes combustion exhaust to pass through the gap, leading to the deterioration of thermal efficiency.

As the thermal efficiency deteriorates, the combustion exhaust maintains a relatively high temperature even after passing through a heat exchanger, leading to a possibility of an exhaust duct and other components placed on the downstream side relative to the heat exchanger being heated by a high-temperature combustion exhaust in the middle of a discharging process with resultant deterioration of durability.

SUMMARY OF THE INVENTION

In view of the respects described above, an object of the present invention is to provide a heat source machine with high thermal efficiency.

To this end, a heat source machine in accordance with the present invention includes: a burner; and a heat exchanger which is heated by combustion exhaust of the burner, wherein the heat exchanger includes: a plurality of water pipes linearly extended; a plurality of fins attached with predetermined intervals provided thereamong along a direction in which each of the water pipes are linearly extended; and a resistance imparting member which is provided on a downstream side in a flowing direction of the combustion exhaust passing between the fins and which imparts resistance to the combustion exhaust passing between the fins, and the resistance imparting member includes: an exhaust passage section which is formed at a position opposing the water pipes and through which the combustion exhaust passes; and a belt-like closing section which opposes an area between the water pipes that are adjoining to each other and which closes a gap between the fins along the direction in which the water pipes are linearly extended.

According to the present invention, the belt-like closing section provided in the resistance imparting member opposes the area between the water pipes (more specifically, opposing the area between the water pipes from the side opposite of the burner), thus securely blocking the flow of the combustion exhaust passing through the fins between the water pipes, unlike the bent protrusion formed by bending a part of each fin as in a prior art. Hence, high thermal efficiency can be obtained by imparting an appropriate resistance to the combustion exhaust passing through the heat exchanger, making it possible to prevent the combustion exhaust from being discharged at a high exhaust temperature.

In addition, the exhaust passage section provided in the resistance imparting member is capable of rectifying the combustion exhaust, to which resistance has been imparted by the closing section in the heat exchanger, and smoothly discharging the combustion exhaust. This makes it possible to prevent excessive resistance from being imparted to the combustion exhaust by the closing section.

In the meantime, if, for example, the downstream ends of the fins and the closing section are not in contact, thus forming a relatively large void between the downstream ends of the fins and the closing section, then the combustion exhaust enters and remains in the void after passing through the fins. Therefore, an appropriate resistance will not be imparted to the combustion exhaust which is passing through the fins, and the combustion exhaust will flow into the void while maintaining a relatively high flow rate, so that the thermal efficiency may not be sufficiently improved.

In the present invention, therefore, the closing section of the resistance imparting member is preferably provided in contact with the end edge of the fin. With this arrangement, unlike the case where the end edges of the fins and the closing section are not in contact, the combustion exhaust that has passed through the fins will be hardly stagnant. Hence, an appropriate resistance will be securely imparted to the combustion exhaust passing through the fins, and the flow rate of the combustion exhaust will be reduced, thus enabling high thermal efficiency to be obtained.

Further, preferably, the burner is placed above the heat exchanger at an attitude such that the flame thereof is formed, being directed downward, and the closing section of the resistance imparting member is formed like a gutter that extends along a linearly extended direction of the water pipes.

If the heat exchanger were placed above the burner, then the drainage produced in the heat exchanger by the combustion of the burner would drip onto the burner and could interfere with smooth combustion. Placing the burner above the heat exchanger makes it possible to securely prevent the drainage from dripping onto the burner from the heat exchanger. Further, in this case, forming the closing section of the resistance imparting member into the gutter-like shape enables the closing section to receive the drainage produced in the heat exchanger, so that the disposal of drainage, such as discharge of the drainage, can be made easier.

DESCRIPTION OF THE PREFERRED EMBODIMENTS

Figure 1:
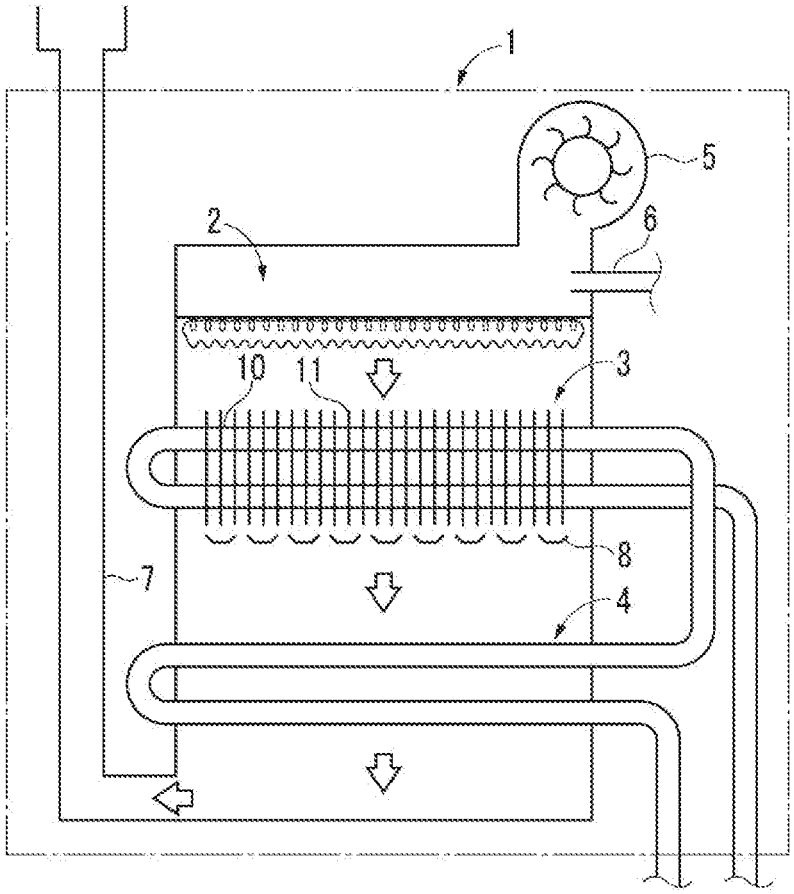
FIG. 1 is a diagram schematically illustrating the configuration of the essential section of a heat source machine according to an embodiment of the present invention.

An embodiment of the present invention will be described with reference to the accompanying drawings, Referring to FIG. 1, which schematically illustrates the major configuration, a heat source machine 1 according to the present embodiment includes a gas burner 2, a sensible heat exchanger 3, and a latent heat exchanger 4.

A fan 5, which sends combustion air to the gas burner 2, is connected to the upper part of the gas burner 2. The gas burner 2 is provided with a combustion surface on the bottom surface thereof and configured to form flames downward. A fuel gas is supplied through a fuel gas supply pipe 6 to the gas burner 2.

The combustion exhaust generated by the combustion of the gas burner 2 moves from top to bottom in the sensible heat exchanger 3, passes through the interior of the latent heat exchanger 4, and then is discharged out of the machine through an exhaust duct 7. The gas burner 2 is provided at the position above the sensible heat exchanger 3, so that the drainage produced in the sensible heat exchanger 3 does not drip onto the gas burner 2. This makes it possible to securely prevent the extinguishment of flames of the gas burner 2 or damage to the combustion surface thereof, thus enabling a good combustion state to be maintained.

Figure 2:
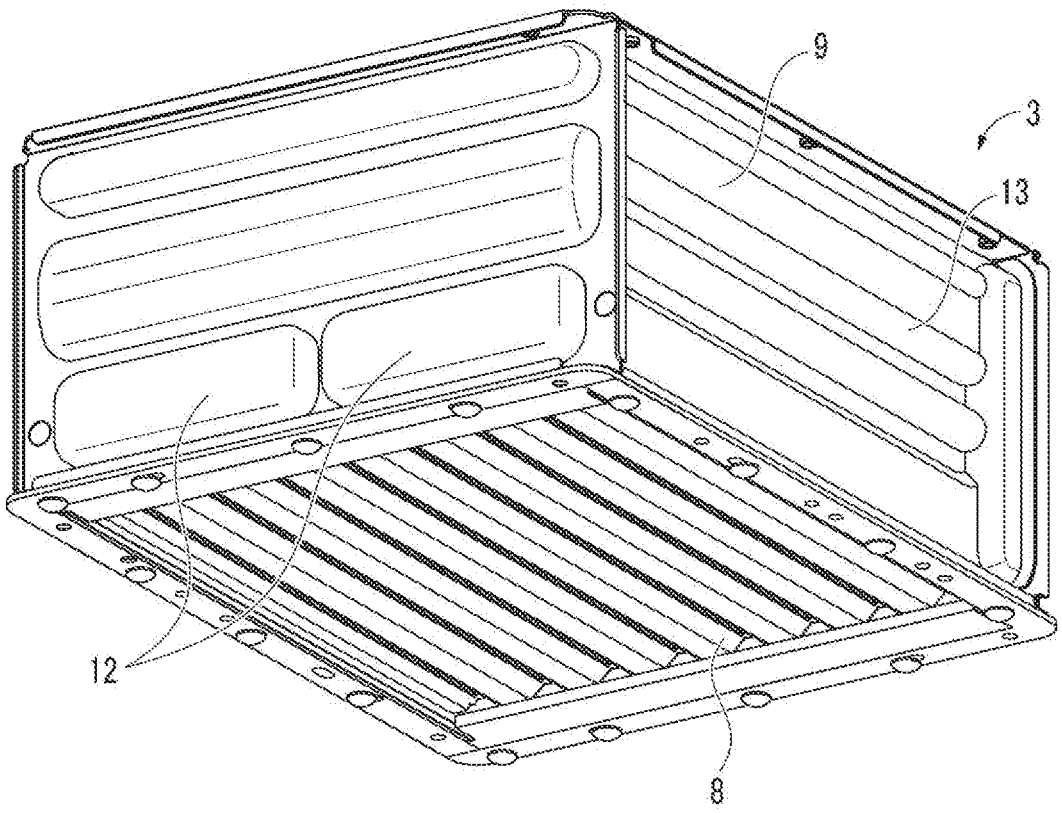
FIG. 2 is a perspective diagram illustrating a heat exchanger according to the present embodiment observed from below.

The gas burner 2 corresponds to the burner in the present invention, and the sensible heat exchanger 3 corresponds to the heat exchanger in the present invention. As illustrated in FIG. 2, a resistance imparting member 8 is attached to the lower surface side of the sensible heat exchanger 3 (the downstream side of the direction in which the combustion exhaust flows).

Figure 3:
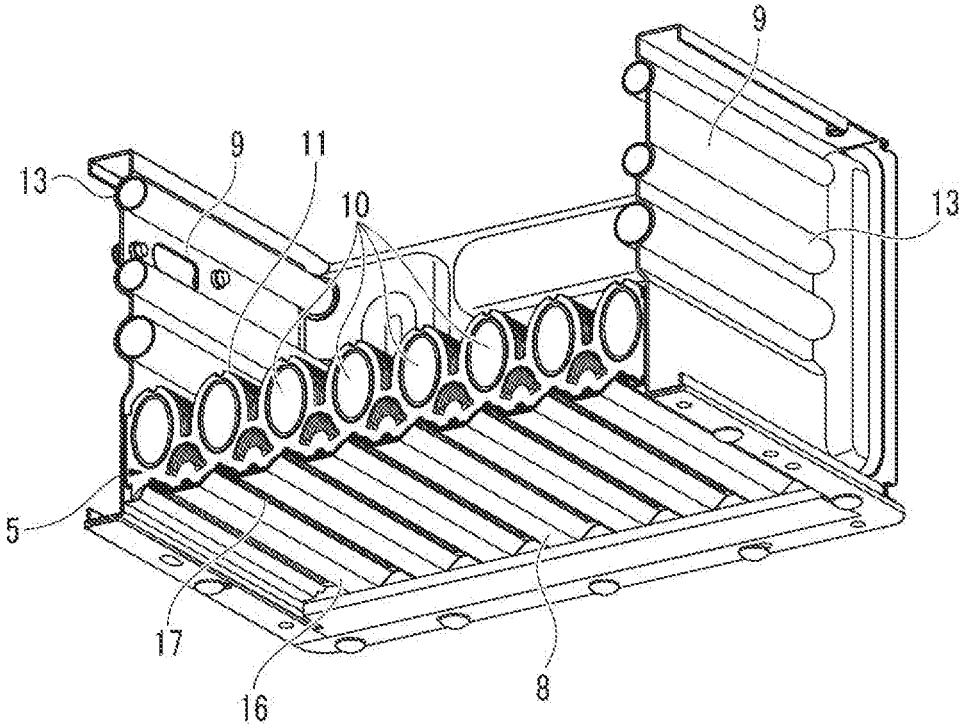
FIG. 3 is an explanatory diagram of the longitudinal section of the heat exchanger of FIG. 2.

As illustrated in FIG. 3, the sensible heat exchanger 3 includes a frame body 9 having a rectangular cylindrical shape, a plurality of water pipes 10 linearly placed inside the frame body 9, and a plurality of fins 11 attached to the water pipes 10.

The water pipes 10, which are linearly extended inside the frame body 9 are connected through connection pipe sections 12 formed in the peripheral wall of the frame body 9, as illustrated in FIG. 2, thus constituting a single water (or heat medium) flow passage.

Further, cooling pipe sections 13, which are in communication with the water pipes 10, are formed in the peripheral wall of the frame body 9. The cooling pipe sections 13 cool the frame body 9 by water (or a heat medium) supplied to the water pipes 10, and at the same time, the water (or the heat medium) directed into the water pipes 10 is heated, so that the thermal efficiency of the sensible heat exchanger 3 as a whole is further improved.

In the sensible heat exchanger 3, the connection pipe sections 12 and the cooling pipe sections 13 are formed in the peripheral wall of the frame body 9, as described above, so that relatively fewer parts extend out of the frame body 9, thus providing a compact appearance.

Many fins 11 are provided with predetermined intervals provided thereamong along the extending direction of the water pipes 10. The frame body 9, the water pipes 10, the fins 11, and the resistance imparting member 8 are all formed of stainless steel in the present embodiment, but may alternatively be formed of other metals, such as copper.

Figure 4:
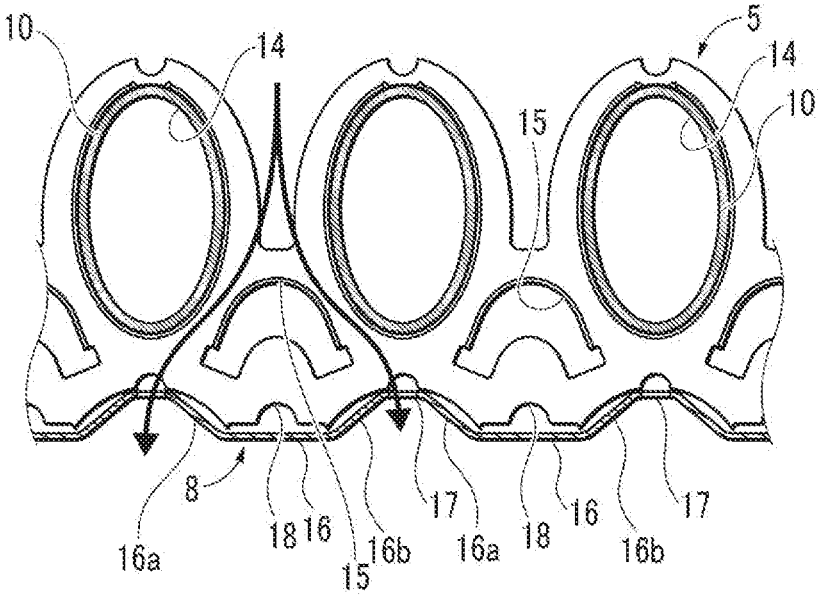
FIG. 4 is an explanatory enlarged view of a part of fins.

Referring to FIG. 4, which illustrates the fins 11 in a partly enlarged view, the fins 11 have circular water pipe insertion holes 14 and bent protrusions 15. The water pipes 10 are passed through the water pipe insertion holes 14. The inner circumferential edges of the water pipe insertion holes 14 are joined to the water pipes 10 by welding or the like, thereby integrally connecting and securing the water pipes 10 and the fins 11.

Each of the bent protrusions 15 is formed by bending a part of each of the fins 11 by burring or the like such that the part protrudes toward another adjoining fin 11. Each of the bent protrusions 15 is placed at a position between the water pipes 10 that are adjoining to each other, thus blocking the flow of combustion exhaust that passes the position and is directed immediately below. The combustion exhaust which has been blocked by the bent protrusion 15 from flowing in the direction immediately below turns into a flow running in the direction of the water pipes 10, so that the endothermic effect of the fins 11 positioned in the vicinity of the water pipes 10 increases. This improves the thermal efficiency.

Figure 5:
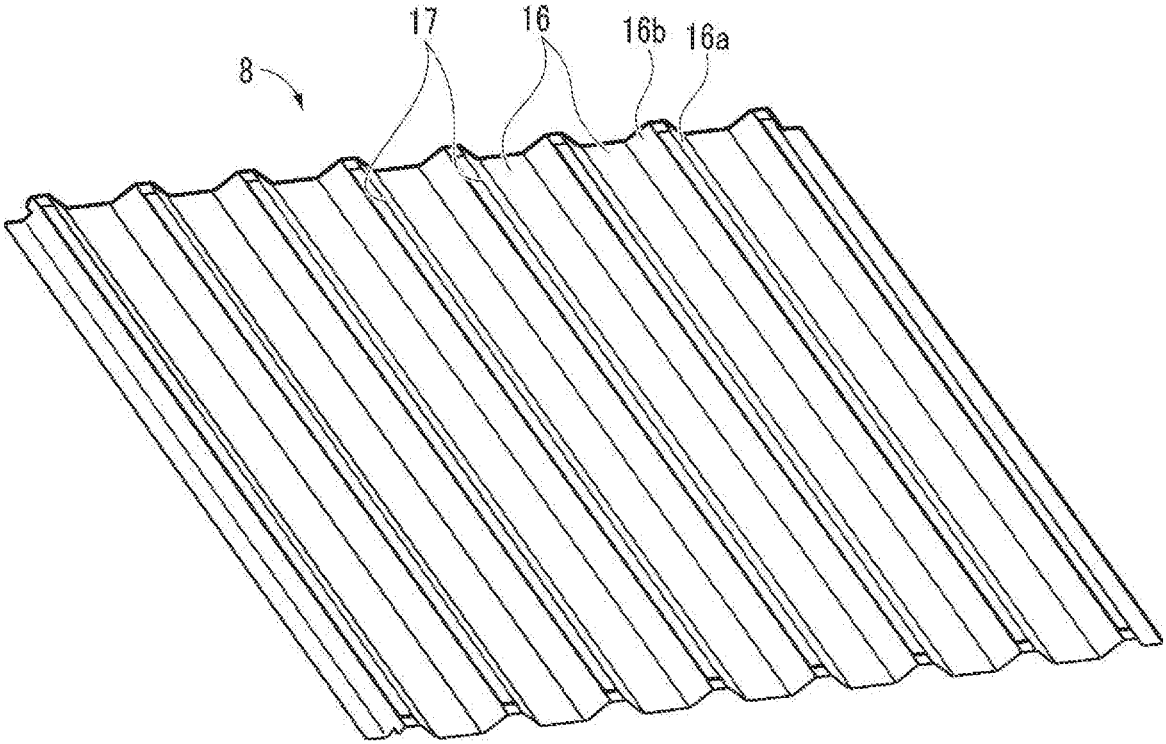
FIG. 5 is a perspective view illustrating a resistance imparting member.

As illustrated in FIG. 5, the resistance imparting member 8 is constituted of belt-like closing sections 16 and slit-like exhaust passage sections 17, which are alternately arranged.

As illustrated in FIG. 4, each of the closing sections 16 is provided, being positioned to oppose the area between the water pipes 10 (more specifically, opposing the area between the water pipes 10 from the opposite side from the gas burner 2) and below each of the bent protrusions 15. Thus, the closing sections 16 continuously close the areas among the fins 11 along the direction in which the water pipes 10 are linearly extended. Each of the bent protrusions 15 is separately provided for each of the fins 11, so that, in some cases, variations or the like occur in bending accuracy, or deformation or the like occurs when attaching the fins 11 to the water pipes 10, and this influence may cause a gap between the bent protrusion 15 and adjoining fins 11, inconveniently allowing combustion exhaust to pass therethrough. For this reason, the closing sections 16 are placed at the positions below the bent protrusions 15 (on the downstream side of the flowing direction of the combustion exhaust), so that even if the gap occurs between the bent protrusion 15 and the adjoining fins 11, the flow of the combustion exhaust directed immediately below can be securely blocked. With this arrangement, the flow rate of the combustion exhaust passing through the fins 11 is appropriately reduced by the resistance imparted by the closing sections 16, thus leading to improved thermal efficiency.

Further, as illustrated in FIG. 4, the closing sections 16 are provided in contact with the downstream-side end edges of the fins 11. Since the closing sections 16 are in contact with the lower end edges of the fins 11, the stagnation of the combustion exhaust between the closing sections 16 and the lower end edges of the fins 11 can be controlled to a minimum, so that the thermal efficiency can be further improved.

Further, in the present embodiment, the lower end portion of each of the fins 11 between the water pipes 10 is shaped to project downward, and the closing sections 16 are shaped to have concave (gutter-like) sections, corresponding to the shapes of the lower end portions of the fins 11. Each of the closing sections 16 has the gutter-like shape and has a pair of walls 16*a* and 16*b* rising aslant upward (the opposing interval increasing upward) along both side edges of the closing sections 16, thus making it possible to receive the drainage produced between the fins 11.

Further, in the present embodiment, as illustrated in FIG. 4, a cutout 18 is formed in a part of the end edge of each of the tins 11 that is in contact with the closing section 16, forming an extremely small gap between the closing section 16 and the end edge of the fin 11. With this arrangement, the drainage received by the closing section 16 will not be blocked by the fin 11, and the drainage on the gutter-like closing section 16 will smoothly flow, thus making it easy to discharge the drainage.

As illustrated in FIG. 4, the exhaust passage sections 17 are formed at positions opposing and below the water pipes 10, and are open in the extending direction of the water pipes 10 at the positions immediately below the water pipes 10. With this arrangement, the combustion exhaust blocked by the closing sections 16 can be rectified and smoothly led out from the exhaust passage sections 17.

In addition, the walls 16*a* and 16*b* of each of the closing sections 16 are formed on both sides of the exhaust passage section 17 that extend along the water pipes 10. The interval between the walls 16*a* and 16*b* gradually increases from top toward bottom, provided that the exhaust passage section 17 is defined as the center. With this arrangement, the combustion exhaust passing through the exhaust passage section 17 is securely rectified by the walls 16*a* and 16*b* of the closing section 16, which are positioned on both sides thereof, so that the combustion exhaust can be further smoothly passed therethrough.

In the present embodiment, the gas burner 2 is provided above the sensible heat exchanger 3; however, the present invention is not limited thereto. For example, the present invention can also be applied, although not illustrated, to a case where a resistance imparting member is provided above a heat exchanger (on the downstream side of the flowing direction of combustion exhaust passing through fins) and a gas burner is provided below the heat exchanger. In this case, although the closing sections of the resistance imparting member do not receive drainage, the same effect for improving thermal efficiency as that of the present embodiment can be obtained.

DESCRIPTION OF REFERENCE NUMERALS

1 . . . heat source machine; 2 . . . gas burner (burner); 3 . . . sensible heat exchanger (heat exchanger); 8 . . . resistance imparting member; 10 . . . water pipe; 11 . . . fin; 16 . . . closing section; and 17 . . . exhaust passage section.

What is claimed is:

1. A heat source machine comprising:

a burner; and a heat exchanger heated by combustion exhaust of the burner, wherein the heat exchanger comprises: a plurality of water pipes linearly extended; a plurality of fins attached with predetermined intervals provided thereamong along a direction in which each of the water pipes are linearly extended; and a resistance imparting member which is provided on a downstream side of a flowing direction of the combustion exhaust passing between the fins and which imparts resistance to the combustion exhaust passing between the fins, and the resistance imparting member comprises: an exhaust passage section which is formed at a position opposing each water pipe and through which the combustion exhaust passes; and a belt-like closing section which opposes an area between the water pipes that are adjoining to each other and which closes a gap between the fins along the direction in which the water pipes are linearly extended.

2. The heat source machine according to claim 1, wherein the closing section of the resistance imparting member is provided in contact with an end edge of the fin.

3. The heat source machine according to claim 1, wherein the burner is placed above the heat exchanger at an attitude that the flame thereof is formed, being directed downward, and the closing section of the resistance imparting member is formed like a gutter that extends along a linearly extended direction of the water pipes.

* * * * *